US005308550A

United States Patent [19]

Friloux

[11] Patent Number: 5,308,550

[45] Date of Patent: May 3, 1994

[54] CLEANING, WETTING AGENT AND SOLVENT

[75] Inventor: Edward E. Friloux, Lafayette, La.

[73] Assignee: Delta Omega Technologies, Ltd., Lafayette, La.

[21] Appl. No.: 755,186

[22] Filed: Sep. 5, 1991

[51] Int. Cl.[5] ..... C11D 1/18

[52] U.S. Cl. ..... 252/544; 252/153; 252/558; 252/559

[58] Field of Search ..... 252/153, 544, 558, 559

[56] References Cited

U.S. PATENT DOCUMENTS 4,169,075 9/1979 Kuhling et al. ..... 252/558
4,594,184 6/1986 Cook et al. ..... 252/DIG. 14
4,970,029 11/1990 Halas ..... 252/DIG. 14
4,978,475 12/1990 Halas ..... 252/558
5,057,246 10/1991 Bertho et al. ..... 252/DIG. 14

*Primary Examiner*—Patrick P. Garvin
*Assistant Examiner*—E. D. Irzinski
*Attorney, Agent, or Firm*—Keaty & Keaty

[57] ABSTRACT

The invention relates to compounds suitable for use as cleaning, wetting solvent agent which contains the active ingredients of dodcylbenzenesulfonic acid, ethoxylated nonyl phenol, lauric acid diethanolamide, diethanolamine and propylene glycol. The cleaning, wetting solvent agent forms a composition which exhibits nonhazardous properties and is biodegradable.

9 Claims, No Drawings

CLEANING, WETTING AGENT AND SOLVENT

BACKGROUND OF THE INVENTION

The present invention relates to cleaning agents, and more particularly to a chemical composition for use as a cleaning, wetting agent and solvent and in other suitable applications.

Various cleaning compositions and solvents are known in the industry.

Some of the solvents are used in textile industry and act as wetting agents in a process designed to remove sizing from cloth before the fabric is dyed or printed.

At the present time, petroleum-based wetting agents are widely used in the process of sizing. Such wetting agents create a number of environmental problems, since they are toxic and cannot be easily disposed of under current EPA regulations.

There are also certain areas in equipment servicing which require that cleaning of surfaces be done in such a manner that there is no film or residue remaining. For example, oxygen breathing equipment requires that the tubing, connectors, gauges and other surfaces be cleansed on a regular basis without any residue or particles of dirt left on the surfaces.

Repair of articles made of rubber or vinyl requires that the surface surrounding a tear or puncture be thoroughly cleaned of any impurities before a patch is adhered to the damaged area.

Electronic circuit printboards have to be regularly cleaned to prevent disfunction of the electronic device due to accumulation of dust or other foreign material on the surface.

In these and other numerous instances cleaning agents containing chlorofluorocarbons are widely used. In 1979 the U.S. Government prohibited the use of this propellant gas for aerosol sprays, except for a few specialized items, because of chlorofluorocarbon's depleting effect on stratospheric ozone.

Along with chlorofluorocarbons, toluene, methyl chloride, trichloroethane (1,1,1) , trichlorotrifluoroethane (CFC 113), and a number of other hazardous materials are used as solvent cleaning agents, dilutants, thinners, etc. Both Toluene and methyl chloride are toxic, flammable, contain explosion risk, therefore requiring careful handling and disposal.

The present invention contemplates provision of a cleaning, wetting solvent agent which is non-toxic, non-flammable and economical, which does not deplete the ozone layer.

SUMMARY OF THE INVENTION

It is therefore an object of the present invention to provide a cleaning, solvent agent which is economical and safe to manufacture.

It is a further object of the present invention to provide an non-toxic, non-flammable, non-hazardous, biodegradable cleaning and solvent agent.

It is still a further object of the present invention to provide a composition of matter suitable for use as cleaning solvent agent in numerous concentrations from 0.01 to 0.99% in a water base.

There remains a further objective, with the present invention, to replace solvents in metal fabrication/-cleaning industries, circuit board cleaning and defluxing, ocular lens cleaning and other applications, so as to effectively remove all traces of grease and oil, leaving no residue on the surfaces being cleaned.

Still a further object of the invention is to provide a dispersant which maintains a buoyancy effect on dispersed hydrocarbons, making collection and disposal of contaminants easier and more cost-effective.

These and other objects of the present invention are achieved by providing a composition of matter which comprises dodecylbenzenesulfonic acid, ethoxylated nonyl phenol, lauric acid diethanolamide, diethanolamine and propylene glycol mixed in a water base. In one of its embodiments the composition of matter provides for a mixture in water of between about 0.17% and 1.36% by total weight of ethoxylated nonyl phenol, mixed with dodecylbenzenesulfonic acid in an amount between about 2 and 2.5 times the concentration of ethoxylated nonyl phenol, lauric acid diethanolamide in amount between about 1.5 and 2 times the concentration of the dodecylbenzenesulfonic acid, and diethanolamine and propylene glycol in equal amounts of between about 2 and 2.5 times the concentration of lauric acid diethanolamide. In its preferred embodiment, the composition of matter provides for the use of 3% by total weight of dodecylbenzenesulfonic acid, 0.3% by total weight of ethoxylated nonyl phenol, 5.66% by total weight of lauric acid diethanolamide and equal amounts of 2.46% by total weight of diethanolamine and propylene glycol all mixed in a water base.

DETAILED DESCRIPTION OF THE PREFERRED EMBODIMENT

The composition of matter in accordance with the present invention comprises between about 0.17–2.36% by weight of ethoxylated nonyl phenol, between about 2.83–22.6% by weight of lauric acid diethanolamide, between about 1.23–9.84% by lo weight of diethanolamine and between 1.23–9.84% by weight of propylene glycol in aqueous solution. The cleaning, solvent agent of the present invention is a synthetic detergent compound which uses dodecylbenzene as a detergent agent and diethanolamide as an emulsifier. The composition concentrate of the present invention exhibits all of the positive qualities of the petroleum-based solvents and chlorofluorocarbon-containing cleaning agent, while eliminating the negative attributes of these compositions. It was found that 0.1–0.99% concentrations of the composition of matter of the instant application are affective as solvents and cleaning agents, although effectiveness is not lost in less concentrated solutions. The present composition was found to be especially effective in applications, wherein safe solvents and no-residue cleaning agents are required.

The composition of the present invention is non-toxic, non-corrosive, non-flammable, non-hazardous, biodegradable and, since it uses no halons, causes no ozone layer depletion. The composition of the present invention exhibits the following physical properties:

| Properties | Data |
|---|---|
| Color | Clear colorless liquid |
| Odor | Mild surfactant odor |
| Weight | 8.34 pounds per gallon |
| ph | 9.0 |
| Specific gravity | About 1.00 |
| Boiling point | 220 degrees Fahrenheit |

Following are examples of the compound in accordance with the present invention which is useful in producing a particular type of the solvent, cleaning and wetting agent.

EXAMPLE 1

25.07% by weight of water was placed in a vat.

In a separate vat by 1.5 percent by weight of the dodecylbenzene sulfonic acid was premixed with 0.17% by weight of ethoxylated nonyl phenol. After thorough blending of the materials in the second vat, the premixed materials were added to the first vat containing water. With continuing stirring 2.83% by weight of lauric acid diethanolamide, then 1.23% by weight of diethanolamine and then 1.23% by weight of propylene glycol were added. The balance of 67.97% by weight of water was added to the mixture, which was continued to be stirred for an additional 15 minutes.

EXAMPLE 2

25.07% by weight of water was deposited in a vat. In a separate vat 3% by weight of dodecylbenzenesulfonic acid was mixed with 0.34% of ethoxylated nonyl phenol. The resultant composition was thoroughly blended and then deposited in the first vat containing water.

To the first vat the following ingredients were added while continuously stirring: 5.66% by weight of lauric acid diethanolamide, 2.46% by weight of diethanolamine and 2.46% of propylene glycol. Then 61.01% by weight of water was added, and the mixture was stirred for an additional 15 minutes.

EXAMPLE 3

25.07% of water was deposited in a vat. In a separate vat 12% by weight of dodecylbenzenesulfonic acid was premixed with 1.36% by weight of ethoxylated nonyl phenol. The mixture was thoroughly blended and then deposited into the first vat containing water. While continuously stirring the following ingredients were added to the first vat: 22.64% of lauric acid diethanolamide, 9.84% by weight of diethanolamine and 9.84% by weight of propylene glycol. Finally, 19.25% by weight of water was added to the mixture which was stirred for an additional 15 minutes.

The resultant composition has specific gravity of about 0.97–1.09, depending on the amount of active ingredients in the aqueous solution and exhibits other physical properties aforementioned.

The resultant composition successfully replaces petroleum-based solvents, and can be used as a wetting agent to aid in emulsification of the various sizing materials adapted for use, for example, in textile industry. The composition, after it served its purposes, can be safely disposed of by discharging into a plant's sediment pond prior to discharge into a municipal waste treatment system.

The composition of the present invention can be used for a number of cleaning jobs, especially those which require that no film or residue is left on the surface.

For example, it can be used f or hard metal cleaning in aqueous solutions having a dilution ratio of from about 0.1 to 1.0.

The composition can be used in cleaning of oxygen breathing equipment in aqueous solutions having a dilution ratio of from about 0.1 to 1.0 without causing any danger of explosion or fire.

The composition can be utilized in preparing rubber or vinyl surfaces for repair in aqueous solutions having a dilution ratio of from about 0.1 to 1.0. In the same dilution proportions the composition of the instant invention can be used for cleaning circuit printboards of electronic devices. Another exemplary use can be found in the field of cleaning delicate precision optical devices, or even ocular glass or plastic lenses. The ratio of dilutions would be approximately the same. The composition is effective as a wetting agent for use in textile industry and other applications, where the reduction of the surface tension of water is a requirement.

The composition of the present invention is nontoxic, non-flammable, non-explosive, does not release ozone depleting substances, can be discharged into municipal waste systems along with the water which is used for rinsing off of the solution. The discharge diluted as described above meets with the current requirements of environmental safety agencies.

Many other uses of the composition of the present invention will be apparent to those skilled in the art.

While a number of examples were described herein, it is to be understood that many changes can be made in the present invention by those skilled in the art without departing from the spirit thereof. I, therefore, pray that my rights to the present invention be limited only by the scope of the appended claims.

I claim:

1. A composition of matter suitable for use as a cleaning, wetting solvent agent, consisting essentially of:

a mixture of between about 5% and 12% by total weight of dodecylbenzenesulfonic acid, between about 0.17% and 1.36% by total weight of ethoxylated nonyl phenol, between about 2.83% and 22.64% by total weight of lauric acid diethanolamide, between about 1.23% and 9.84% by total weight of diethanolamine and between about 1.23% and 9.84% by total weight of propylene glycol in water.

2. A composition of matter suitable for use as a cleaning, wetting solvent agent, consisting essentially of:

a mixture in water of between about 0.17% and 1.36% by total weight of ethoxylated nonyl phenol; dodecylbenzenesulfonic acid in an amount between about 2 and 2.5 times the concentration of ethoxylated nonyl phenol; lauric acid diethanolamide in an amount between about 1.5 and 2 times the concentration of dodecylbenzenesulfonic acid; and diethanolamine and propylene glycol in equal amount of between about 2 and 2.5 times the concentration of lauric acid diethanolamide.

3. A cleaning, wetting solvent agent, consisting essentially of:

dodecylbenzenesulfonic acid;
diethanolamine;
ethoxylated nonyl phenol;
lauric acid diethanolamide; and
propylene glycol
mixed in an aqueous base.

4. The agent of claim 3, wherein the composition contains at least 1.5% by total weight of dodecylbenzenesulfonic acid.

5. The agent of claim 3, wherein the composition contains at least 2.83% by total weight of lauric acid diethanolamide.

6. The agent of claim 3, wherein the composition contains at least 1.23% by total weight of diethanolamine and an equal amount of propylene glycol.

7. The agent of claim 3, wherein the composition contains at least 0.17% by total weight of ethoxylated nonyl phenol.

8. A cleaning, wetting solvent agent, consisting essentially of:

an aqueous solution of dodecylbenzenesulfonic acid, from 1.5% to 12% by total weight;

up to about 1.36% of total weight of ethoxylated nonyl phenol;

lauric acid diethanolamide, from 2.83% to 22.64% by total weight;

diethanolamine and propylene glycol in equal amounts from 1.23% to 9.84% by total weight;

mixed in an aqueous base.

9. A composition for use as an effective solvent, wetting agent which consisting essentially of from 1.5% to 12% by total weight of the dodecylbenzenesulfonic acid, from 0.17% to 1.36% by total weight of the ethoxylated nonyl phenol, from 2.83% to 22.64% by total weight of lauric acid diethanolamide, equal amounts of between about 1.23% and 9.84% by total weight of diethanolamine and propylene glycol mixed in water to form between 2% and 6% concentrate.

* * * * *